US010297917B2

(12) United States Patent
Klein et al.

(10) Patent No.: US 10,297,917 B2
(45) Date of Patent: May 21, 2019

(54) DUAL KA BAND COMPACT HIGH EFFICIENCY CP ANTENNA CLUSTER WITH DUAL BAND COMPACT DIPLEXER-POLARIZERS FOR AERONAUTICAL SATELLITE COMMUNICATIONS

(71) Applicant: AEROANTENNA TECHNOLOGY, INC., Chatsworth, CA (US)

(72) Inventors: Joseph Klein, Chatsworth, CA (US); Wenhao Zhu, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 0 days.

(21) Appl. No.: 16/191,840

(22) Filed: Nov. 15, 2018

(65) Prior Publication Data

US 2019/0089058 A1 Mar. 21, 2019

Related U.S. Application Data

(62) Division of application No. 15/256,897, filed on Sep. 6, 2016, now Pat. No. 10,181,645.

(51) Int. Cl.

| | |
|---|---|
| ***H01Q 13/00*** | (2006.01) |
| ***H01Q 5/55*** | (2015.01) |
| ***H01Q 1/36*** | (2006.01) |
| ***H01Q 1/28*** | (2006.01) |

(52) U.S. Cl.
CPC ..... *H01Q 5/55* (2015.01); *H01Q 1/288* (2013.01); *H01Q 1/36* (2013.01)

(58) Field of Classification Search
CPC ..... H01Q 5/55; H01Q 1/288; H01Q 1/36
USPC ..... 343/786
See application file for complete search history.

(56) References Cited

U.S. PATENT DOCUMENTS

| | | | | |
|---|---|---|---|---|
| 2,751,586 | A * | 6/1956 | Riblet | H01Q 25/02 342/153 |
| 3,380,052 | A * | 4/1968 | Morion | F02M 41/127 342/147 |
| 3,482,251 | A * | 12/1969 | Bowes, Jr. | H01Q 25/02 343/776 |
| 4,096,482 | A * | 6/1978 | Walters | H01Q 21/245 342/373 |
| 5,406,298 | A * | 4/1995 | Walters | H01Q 13/0275 343/776 |
| 5,614,916 | A | 3/1997 | Mizuguchi | |
| 5,914,694 | A * | 6/1999 | Raab | H01Q 13/22 343/725 |
| 6,031,507 | A * | 2/2000 | Aoki | H01Q 19/17 343/776 |
| 6,118,412 | A | 9/2000 | Chen | |
| 6,181,291 | B1 | 1/2001 | Anderson et al. | |
| 6,201,508 | B1 * | 3/2001 | Metzen | H01Q 13/0258 343/776 |
| 6,535,174 | B2 | 3/2003 | Rao et al. | |
| 6,839,037 | B1 | 1/2005 | Stokes et al. | |
| 7,564,421 | B1 * | 7/2009 | Edwards | H01Q 13/0241 333/137 |

(Continued)

*Primary Examiner* — Huedung X Mancuso
(74) *Attorney, Agent, or Firm* — Burr Forman McNair

(57) ABSTRACT

The present invention is a dual Ka-band, compact, high efficiency CP antenna cluster with dual band compact diplexers-polarizers that can be used as a basic building block for mobile satellite antenna arrays that require minimal dimensions and high efficiency.

2 Claims, 6 Drawing Sheets

(56) References Cited

U.S. PATENT DOCUMENTS

| | | | | |
|---|---|---|---|---|
| 7,755,557 | B2 | 7/2010 | McGonigle et al. | |
| 8,403,527 | B2 | 3/2013 | Brukilacchio | |
| 9,450,308 | B1 | 9/2016 | Lewis, Jr. | |
| 9,559,428 | B1 * | 1/2017 | Jensen | H01Q 15/242 |
| 2004/0056814 | A1 | 3/2004 | Park et al. | |
| 2013/0162490 | A1 | 6/2013 | Blech | |
| 2016/0020520 | A1 | 1/2016 | McCarrick et al. | |
| 2016/0273034 | A1 | 9/2016 | Lundquist et al. | |
| 2017/0077610 | A1 | 3/2017 | Bongard et al. | |
| 2017/0357101 | A1 | 12/2017 | Tervo et al. | |

* cited by examiner

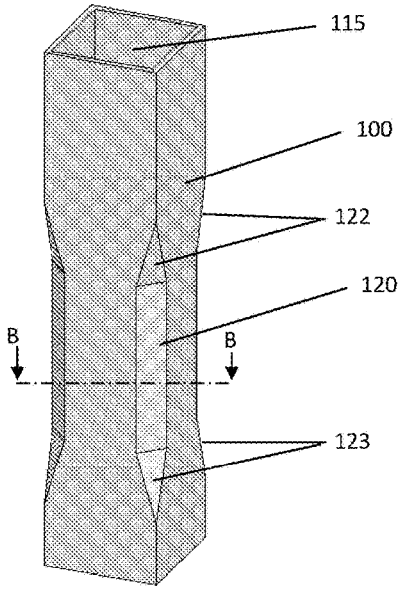
Fig.4a
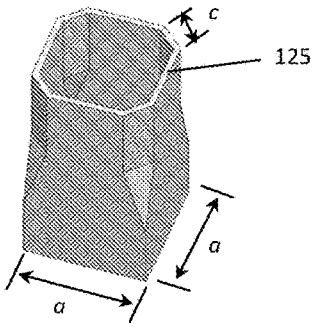
Fig. 4b B-B section
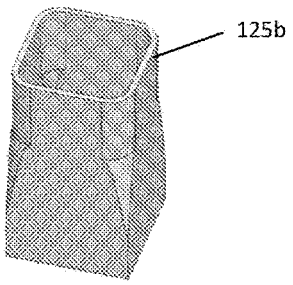
Fig. 4c B-B section
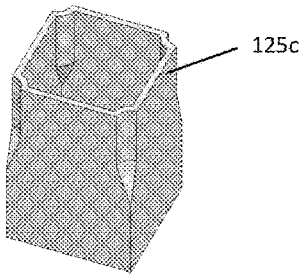
Fig.4d B-B section

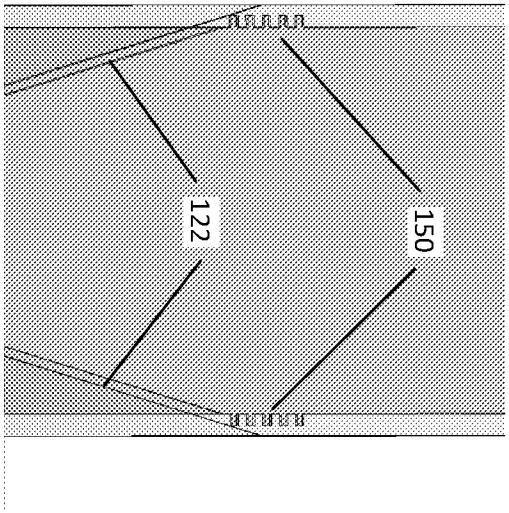
Fig.5a, section A-A of Fig2 for the groove arrays.
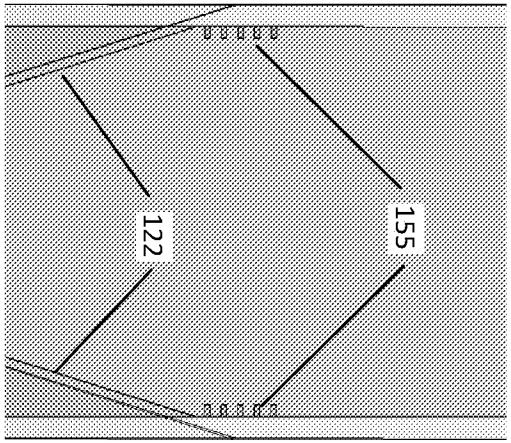
Fig.5b, section A-A of Fig.2 for the iris arrays.

DUAL KA BAND COMPACT HIGH EFFICIENCY CP ANTENNA CLUSTER WITH DUAL BAND COMPACT DIPLEXER-POLARIZERS FOR AERONAUTICAL SATELLITE COMMUNICATIONS

CROSS-REFERENCE TO RELATED APPLICATIONS

This application is a division of U.S. application Ser. No. 15/256,897 filed Sept. 6, 2016, the entire contents of which are hereby incorporated by reference in its entirety.

FIELD OF THE INVENTION

The present invention relates to dual band, horn type antennas.

BACKGROUND OF THE INVENTION

The need for high-speed internet and data communication for aircrafts in flight has been growing in the past decade. Broadband transmission schemes and systems between mobile carriers and satellite networks have been proposed and implemented to meet such aeronautical applications. Mobile satellite antennas for aeronautical applications need to be compact in size, light weight, high gain, and cause little interference to adjacent satellites. Waveguide-fed horn antennas and arrays have been the preferred choice for such applications, in particular for Ku band data transmission, because of their high aperture efficiency, low radio-frequency (RF) loss, and compact dimensions. As the communication frequency increases from Ku band to Ka band (up to 31 GHz) to meet the growing demand of high data-rate and low cost, antenna subsystems are facing more stringent requirements from both airliners and the regulatory commission.

For Ka band communication, air-born satellite antennas are required to use circular polarization (CP) in transmitting and receiving RF signals. In addition, the transmitting operation uses a higher frequency band (27.5-31 GHz) with right- or left-hand circular polarization (RHCP or LHCP), and the receiving operation occurs in a lower frequency band (17.7-21.2 GHz) with the opposite circular polarization. To generate CP RF fields with a horn antenna, two orthogonally linear-polarized (LP) wave fields with 90 degree phase difference are needed that propagate from the feed-waveguide to the horn aperture. To achieve this, a polarizer is usually required that converts single LP wave field into two orthogonal LP wave fields with required phase difference. Due to the high frequencies used and limited radome space, it's critical that proposed polarizers, waveguide feed networks, and horn antennas are as compact as possible, and can be easily integrated together to achieve a high array aperture efficiency.

Various techniques have been proposed for circular polarization in waveguides for general purpose, including capacitive or inductive iris loading in a square waveguide [1], a stepped septum [2], a linear-slope [3] or a curved-slope [4] septum in a square waveguide, and dielectric slabs in circular waveguides [5]. However, those techniques either work for only one relative narrow frequency band, or if capable of broadband or dual band, lack of a frequency or polarization diplexing function, or are large in size and cannot meet the limited space requirements for airborne Ka-band satellite antennas. There are two key issues that a circular polarizer needs to address to be able to use with aeronautical Ka-band satellite horn antennas, in particular, in array environment.

First, because of the requirements of minimum possible size and weight, a CP antenna or array must work as both the transmitter (RHCP) and receiver (LHCP), which means a circular polarizer should possess the polarization diplexing function to eliminate a separate diplexer. Septum based circular polarizers are also CP diplexing, due to their bifurcation nature, whereas, those polarizers based on irises, dielectric slabs, etc, need additional LP diplexers, such as an orthogonal mode transducer (OMT), which significantly increases the size and weight.

Second, because of the requirements of maximum antenna efficiency, a square aperture is preferred for CP horn antennas in array environments (circular aperture results in much lower array aperture efficiency due to the gaps between circular areas). So are the cross sections of the feeding waveguides and polarizers. For square waveguides, the dominant guided modes are TE10/TE01 (the two have same cut-off frequency), and existing septum based circular polarizers [2-4] were usually designed to include only these two dominant modes, which leads to a maximum bandwidth less than 25%. As was mentioned earlier for Ka band communications, the transmitting and receiving bands are quite far separated (the ratio of maximum frequency span to receiving band central frequency is 11.8:19.7) so that to entertain both bands, the waveguide polarizers have to include the TE11 mode, whose cut-off frequency is 1.4 times that for the TE10/TE01 modes and is below the transmitting band. The mode conversion in this case deteriorates the polarization performance in the higher band, and that needs to be addressed.

An approach [6] to avoid the higher order modes' presence was proposed primarily for reflector feeds that uses a dual waveguide structure in the polarizer design, where an inner waveguide polarizer and an out waveguide polarizer are coaxially arranged, each of these septum-based polarizers is operated to include only the dominant TE10/TE01 modes and used for carrying the linear-circular polarization conversion in only one frequency band. However, due to its coaxial dual waveguide structure nature, the proposed polarizer essentially prohibits the use of waveguide feed networks for dual frequency band signals, and therefore in horn array applications, it requires coaxial cable feed networks that would cause significant signal loss for the high frequency Ka band (30 GHz or higher). Besides, the plurality structures of the polarizer would result in a higher fabrication cost compared to single waveguide polarizers.

For waveguide feed networks, a compact patented design [7] has been proposed that consists of only E-plane tees and H-plane bends. However it requires a 90-deg twist at each element antenna port, which adds additional loss and blocks the implementation of two separate waveguide feed networks for transmitting and receiving signals respectively. A recent proposal of a waveguide antenna array for Ku band applications [8] uses a binary tree of E- and H-plane dividers. However, the waveguide network designed has taken up two thirds of the whole array thickness (dimension in the direction normal to the array aperture surface), resulting in shorter horn antennas with lower gain and efficiency.

References

[1] A J. Simmons, "Phase shift by periodic loading of waveguide and its application to broadband circular polarization", IRE Trans. Microwave Theory and Techniques, Vol. MTT-3, pp 18-21, December 1955.

[2] M. H. Chen, and G. N. Tsandoulas, "A wide-band square-waveguide array polarizer", IEEE Trans. Antennas Propag., Vol. AP-32, No. 3, pp 389-391, May 1973.

[3] J. V. Rootsey, "Tapered septum waveguide transducer", U.S. Pat. No. 3,958,193, May 1976.

[4] H. J. Gould, "Balanced phase septum polarizer", U.S. Pat. No. 4,126,835, November 1978.

[5] T. Y. Huang, Y. C. Yu, and R. B. Wu, "dual-band/broadband circular polarizers designed with cascaded dielectric septum loadings", PIERS, Mar. 26-29, 2006, pp 475- 477, Cambridge, USA

[6] S. Enokuma, "Converter for receiving satellite signal with dual frequency band", U.S. Pat. No. 6,522,215 B2, February 2003.

[7] R. G. Edwards, et al, "Compact waveguide antenna array and feed", U.S. Pat. No. 7,564,421 B1, Jul. 21, 2009.

[8] M. Seifried, et al, "Broadband antenna system for satellite communication", U.S. patent application Pub. No. 2011/0267250, Nov. 3, 2011.

SUMMARY OF THE INVENTION

The object of the invention is to provide a dual Ka-band, compact high efficiency CP antenna cluster with dual band compact diplexers-polarizers that can be used as a basic building block for mobile satellite antenna arrays that require minimal dimensions and high efficiency.

In one embodiment of the present invention, a dual Ka band compact waveguide diplexer-polarizer is described that comprises a waveguide with modified cross-section, a septum, and a pair of corrugated surfaces made of grooves or irises on two opposite waveguide walls. In another embodiment of the present invention, a spline-profiled horn antenna and a compact waveguide feed that is used to deliver signals to and from the 2×2 profile horns are described. The feed network only occupies half the thickness of the waveguide horn antenna array.

BRIEF DESCRIPTION OF THE DRAWINGS

FIG. 4*a* is a perspective view of the designed waveguide segment for the polarizer in the invention, FIG. 4*b*, the octagon-shape cross-section B-B, and FIGS. 4*c* and 4*d*, alternative cross-sections B-B.

FIG. 5*a* is a side view of section A-A showing the pair of groove arrays inside the waveguide, and 5*b*, a side view of section A-A showing the pair of iris arrays.

DETAILED DESCRIPTION OF THE INVENTION

The invention is now discussed with reference to the figures.

Figure 1A:
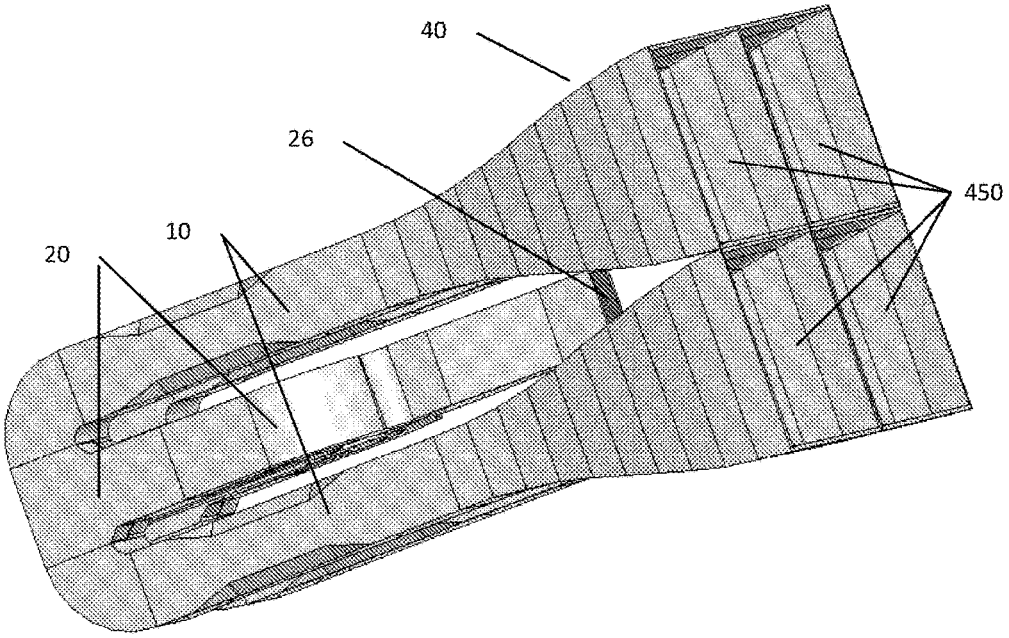
FIGS. 1*a* and b show two different perspective views of the designed dual Ka-band compact waveguide antenna cluster, comprising of 2×2 spline-profiled horns and 2×2 dual band compact polarizers-diplexers in this invention.
Figure 1B:
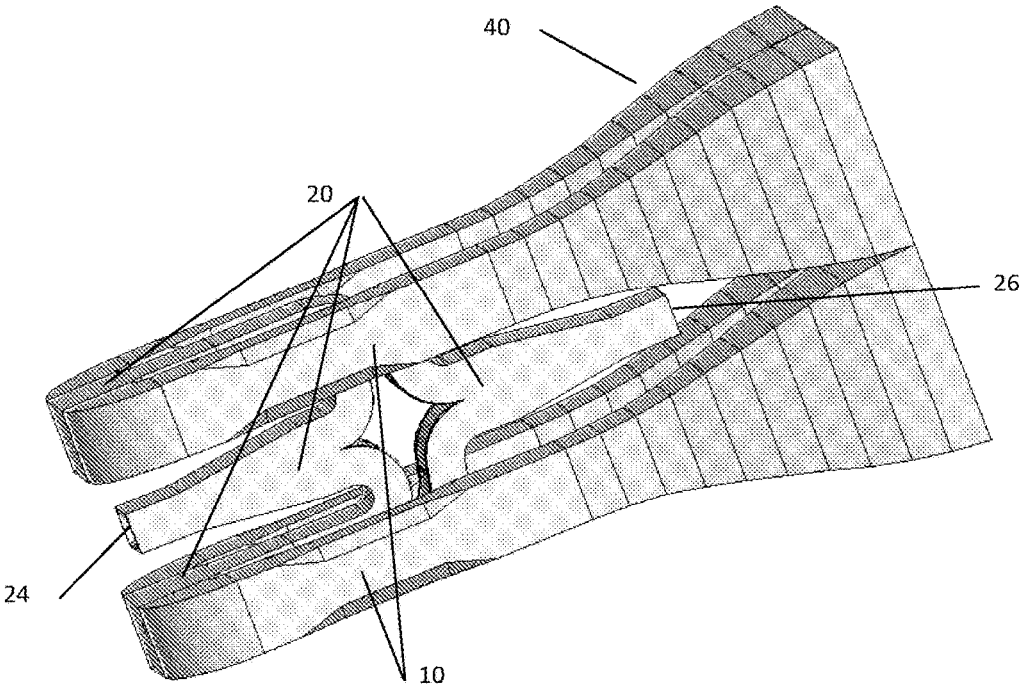

FIG. 1*a* and *b* illustrate the preferred dual Ka band waveguide antenna cluster with 2×2 horns 40, the feed waveguide network 20, and the 2×2 compact waveguide polarizers-diplexers 10 according to the invention. The entire cluster structure is designed to serve as a basic building block or element antenna that can be used to construct a large waveguide antenna array. The cluster's two signal ports 24 for transmitting and 26 for receiving as well as the feed network are located in the gap space among the 4 horns or the 4 polarizers to achieve a compact design, and are ready for cross-connection with adjacent clusters in the two orthogonal directions in a plane parallel to the aperture surface to form a larger array. The waveguide feed networks for clusters (not shown here) will also use the gap space within a cluster and between clusters, and will be located in two separate levels in parallel to the aperture surface for the respective transmitting signal (near port 24) and receiving signal (near port 26). The advantage of using the clusters instead of individual antennas as array element units is that the cluster has twice the size of a single antenna, the latter is quite small, specially, for Ka band, and thus makes the design of waveguide-fed networks for clusters relatively easier and straight forward.

Figure 2:
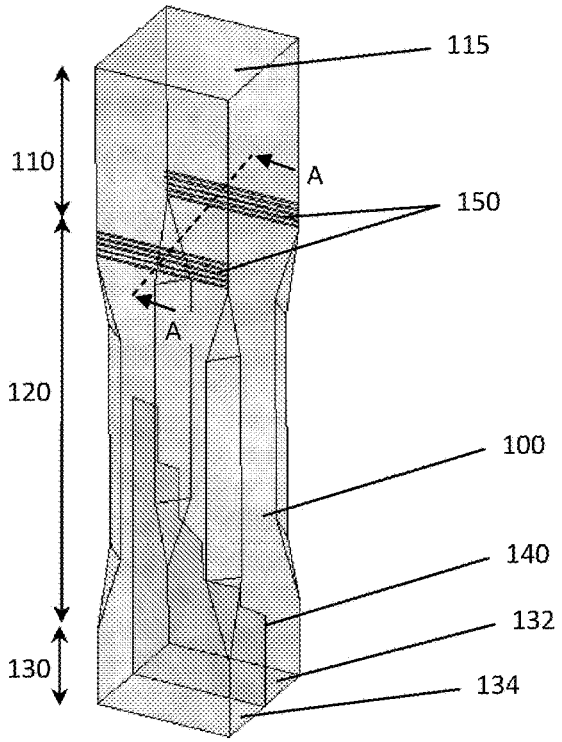
FIG. 2 is a perspective view of the dual Ka-band compact diplexer-polarizer.

The polarizer shown in FIG. 2 includes a square waveguide 100 with a modified cross section in the middle part of the waveguide. The waveguide 100 consists of three segments, a segment 110 with single square aperture that is capable of propagating LHCP and/or RHCP signals, a segment 130 consisting of two identical rectangular aperture waveguides with a common wall that are capable of propagating LP signals each, and a middle segment 120 in between that has an octagon-shape aperture 125 (FIG. 4*b*) and is loaded with a septum 140 and a pair of corrugated surfaces 150. A square-aperture horn antenna 450 (to be described later) transmitting and receiving CP signals is directly connected to the square aperture port 115 at the end of 110. A compact waveguide feed network 20 (to be described later) is used to connect each of the two inline rectangular aperture ports 132 and 134 at the other end of 130 with their corresponding rectangular aperture ports of an adjacent polarizer.

A septum 140 in FIG. 2 is a centrally located conductive wall with varying height along the waveguide 100, and transforms the square aperture 115 at one end of 100 into two rectangular apertures 132 and 134 at the other end of 100. For transmitting CP signals, a LP signal at one of the two rectangular aperture ports will be converted into a LHCP or RHCP signal at the square aperture port, depending on the orientation of the septum's cut-off portion, and the same LP signal applied at the two rectangular aperture ports will always be converted into two opposite polarized CP signals, regardless the septum orientation. For receiving CP signals, the above description is reversed. This common polarization feature of a septum is a well-known prior art, and a description of it can be found in [3].

Figure 3:
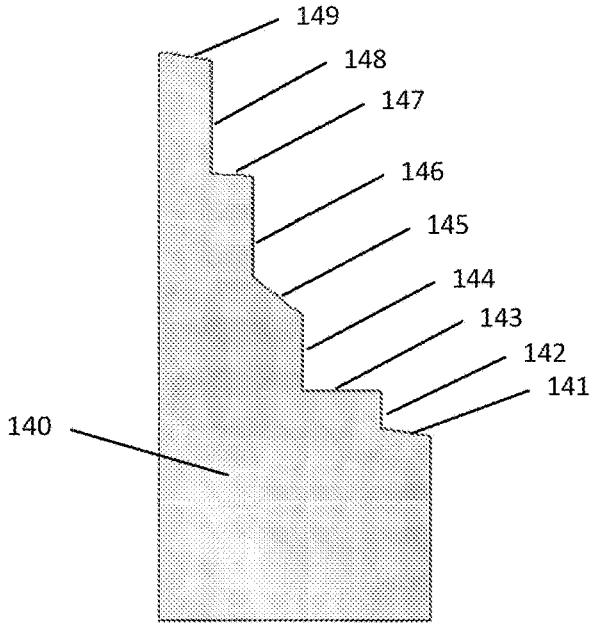
FIG. 3 is a side view of the septum inside the polarizer.

The designed septum 140 in FIG. 3 extends along the waveguide while its height decreases from the full height of the aperture 132 (134) to zero through four steps 141-149, in which three step heights are linearly tapered. The prior art [2] also used a 4-step septum in their polarizer, but our design is different from [2] in that, 1) a linear taper 141 at the first step from the onset of the septum for better impedance matching from the rectangular waveguide to the ridged square waveguide; 2) two more linear tapers 145 and 149, for more balanced phase delays for the dual bands centered at 19.7 GHz and 30 GHz; 3) different normalized step depths and lengths, for example, the normalized step depths here are 141:143:145:147:149=0.184:0.288:0.181:0.156:0.191, compared to 141:143:145:147:149=0.216:0.304:0.197:0.157:0.126 in [2]. Thus, our normalized step depths and lengths cannot be obtained by scaling frequency from theirs in [2]. In fact, our specific sizes (including the tapers) are obtained through a complex parametric analysis for optimized overall performance of the dual band polarizer.

Because of the large frequency span of the dual bands and the compactness of waveguide polarizers, the center frequency of the transmitting band is above the TE11 mode's cut-off frequency, which results in inevitable TE11 mode conversion in square waveguides for the higher frequency band and deteriorates the polarization performance. The middle segment 120 in FIG .4*a* is designed with an octagon-shape cross-section 125 as in FIG. 4*b* to reduce the TE11 mode conversion when LP or CP signals are interacting with the septum. The ratio of the corner edge length c over the square cross-section size a (FIG. 4*b*) is selected to not significantly affect the TE10/TE01 modes. The length of octagon-shape segment should be longer than the septum and should include the transition segments 122 and 123 to minimize the signal reflection due to the cross-section change. Various alternative cross-sections may be used for the same purpose in the middle waveguide segment of the proposed polarizer, as shown in FIGS. 4*b* and *c* for example. Also, the transitions 122 and 123 can be any smooth curve, while those shown in FIG. 4*a* are linearly tapered.

To better balance the phase delays in the dual bands and to match them as close to the desired 90 degree as possible, a pair of corrugated surfaces consisting of groove 150 or iris 155 arrays, as shown in FIG. 5*a* and 5*b,* are made directly on the two opposite walls that are in parallel to the septum plane in the middle segment 120 of the polarizer. The grooves 150 or irises 155 run along the direction perpendicular to the axis of the waveguide polarizer 100. These corrugated surfaces are used for minor adjustments of the phase delays between the two orthogonal LP signals in the higher band. The groove or iris arrays add extra capacitance to the LP signal perpendicular to them, and extra inductance to the LP signal parallel to them, which will slightly change the phase delay between the two orthogonal LP signals. The iris' height or the groove's depth is carefully selected to not increase the signal reflections.

Figure 6:
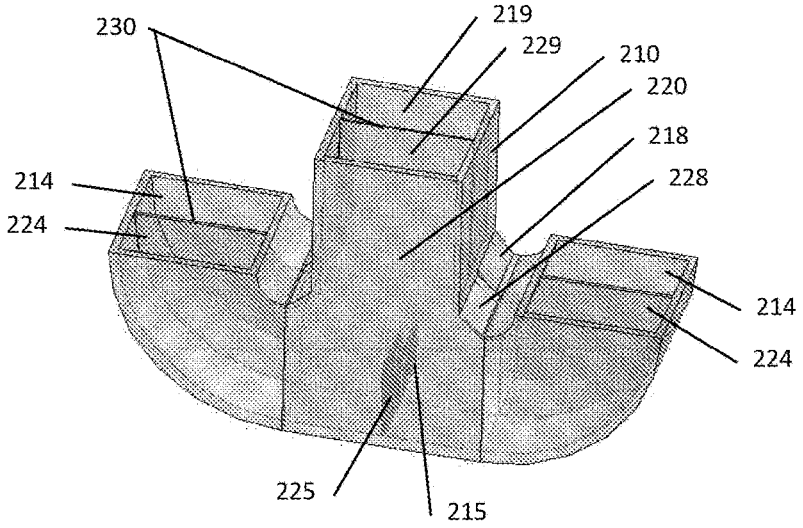
FIG. 6 shows two stacked H-plane tee power dividers with H-plane 90-deg bends for the transmitting and receiving waveguide networks, respectively, each has its own septum designed for the corresponding frequency band.

In another embodiment, FIG. 6 shows a pair of stacked H-plane tee dividers 210, 220 with a common wall 230 for the transmitting and receiving signals, respectively. The stacked tees are designed to join two adjacent polarizers at their coplanar two-port ends 130. Each tee divider includes two H-plane 90-deg bends 214 (224) at the two ends of the "T". Each tee also includes its specific septum 215 (225) and transition parts 218 (228) at the corners of the "T" designed for its operating frequency band. There are two pairs of such stacked tee dividers inside the antenna cluster, and they are arranged in such a way that the two corresponding tees 210 for the transmitting signal are facing each other within the cluster.

Figure 7:
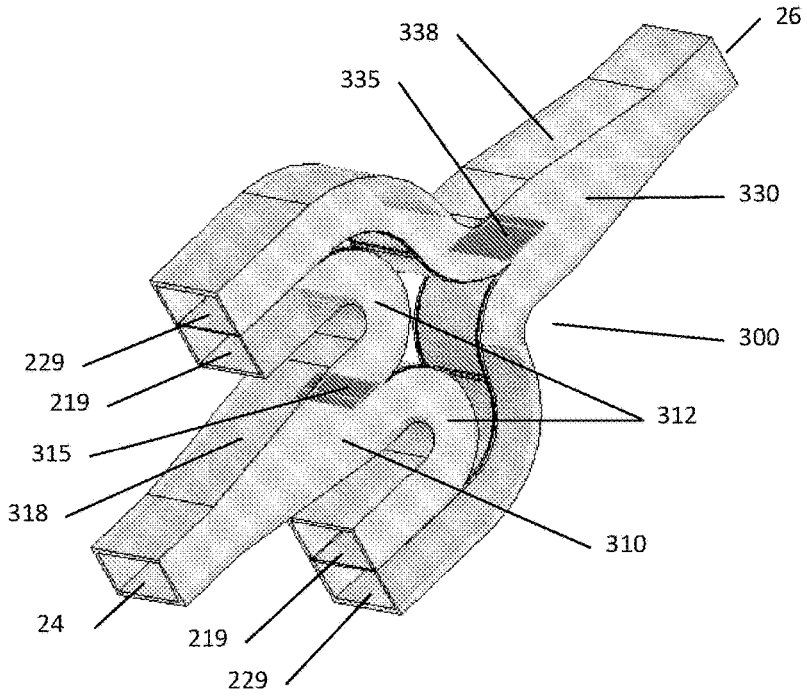
FIG. 7 shows the E-plane Y-power-dividers assembly for the transmitting (inner Y-divider) and receiving (outer Y-divider) waveguides, respectively.

The two inline ports 219, 229 at the combining end of each pair of stacked tees (FIG. 6) will be connected with their counter parts of the other pair of stacked tees using an assembly 300 of two E-plane Y-dividers 310, 330 shown in FIG. 7. The E-plane Y-dividers are designed to make use of the gap space among the 2×2 horns/polarizers, and to carry the transmitting (inner Y-divider 310) and the receiving (outer Y-divider 330) signals. The inner Y-divider 310 has two 180-deg bends 312 with a smaller radius and is, therefore, assigned to the higher band signal with a smaller wavelength. Each Y-divider has its specific septum 315 (335) and tapered transition segment 318 (338) that is designed for the corresponding frequency band. The combination of the H-plane tees and bends with E-plane Y-dividers effectively form two sets of 1-to-4 power dividers, for transmitting and receiving signals, respectively. Each effective 1-to-4 divider has a return loss better than −21 dB (computer simulation) in its operating band.

Figure 8:
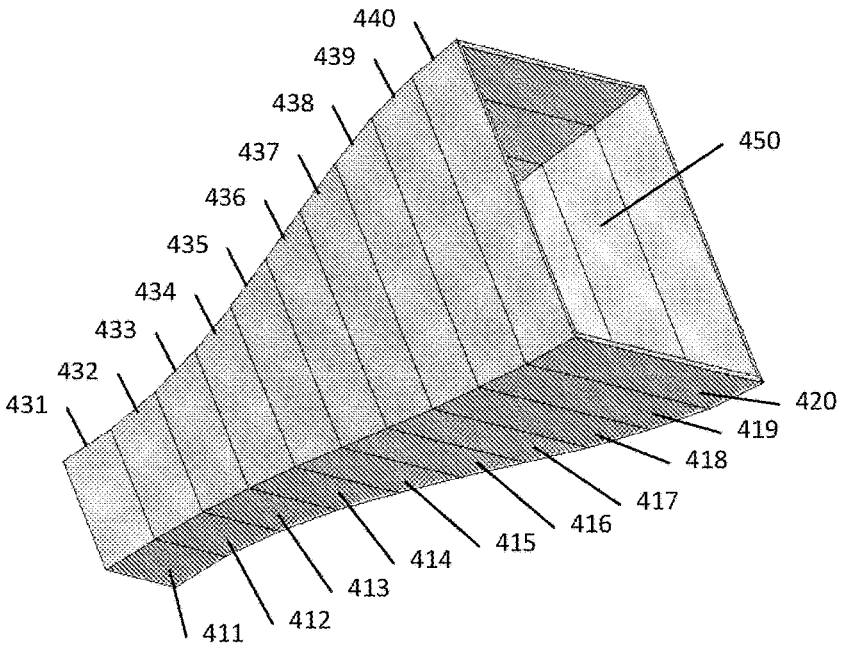
FIG. 8 shows the square aperture horn antenna designed based on a spline-curve profile.

FIG. 8 shows the square aperture horn antenna 450 profiled using an optimized spline curve for the maximum gain in the receiving band at the given aperture size and horn length. The spline curve profile consists of N (>=8) linear segments. A preferred example profile using ten segments (N=10) 411-420 is shown in FIG. 8, and the tangent angles 431-440 (the angle between the wall plane of each segment and the horn axis) of the ten segments have the following preferred ranges, 431=1.00-1.20, 432=5.00-5.30, 433=8.90-9.50, 434=11.80-12.50, 435=13.60-14.10, 436=14.50-15.40, 437=13.90-14.30, 438=12.00-12.50, 439=9.10-9.50, 440=5.20-5.70. The proposed profiled horn adds an extra 4-6% aperture efficiency on top of the optimized efficiency of a pyramid horn of same aperture size and horn length.

A computer simulation shows an overall cluster aperture efficiency better than 82% for the receiving band with the transmitting port 24 terminated with a matched load. Since the feed networks inside the cluster are designed to have low insertion loss in their respective operating band, but relative higher insertion loss for the other band, they add additional isolation between the transmitting and receiving ports on top of the diplexer-polarizer's isolation, which makes the cluster more efficient.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

The invention claimed is:

1. A compact assembly of two sets of 1-to-4 waveguide power dividers for feeding polarizers and horn antennas in a 2×2 configuration, the assembly comprising:

a pair of stacked H-plane tees, each having two identical H-plane 90 degree bends at opposing ends thereof;

a first septum disposed along a symmetrical line of the tees; two transition corners; and an E-plane Y-divider assembly comprising:

an inner Y-divider with two E-plane 180-degree bends at opposing ends thereof, the inner Y-divider having a second septum disposed along a symmetrical line of the inner Y-divider, and a first transition segment, operating at a first frequency band, and an outer Y-divider with two E-plane 90-degree bends at opposing ends thereof, the outer Y-divider having a third septum disposed along a symmetrical line of the outer Y-divider, and a second transition segment, operating at a second frequency band that is lower than the first frequency band.

2. The assembly of claim 1, wherein at least one of the horn antennas comprises a spline-profiled square aperture horn antenna comprising N linear segments with optimized tangent angles with respect to a horn axis, wherein N>8.

* * * * *